US006181327B1

(12) United States Patent
Lin et al.

(10) Patent No.: US 6,181,327 B1
(45) Date of Patent: Jan. 30, 2001

(54) COMPUTER JOYSTICK

(75) Inventors: Shu-Ming Lin, Taipei; A-Ming Chang, Lu-Chou, both of (TW)

(73) Assignee: Primax Electronics LTD, Taipei Hsien (TW)

( * ) Notice: Under 35 U.S.C. 154(b), the term of this patent shall be extended for 0 days.

(21) Appl. No.: 09/129,937

(22) Filed: Aug. 4, 1998

(51) Int. Cl.[7] ..... A63B 71/04
(52) U.S. Cl. ..... 345/161; 345/156; 345/158
(58) Field of Search ..... 345/156, 161, 345/163, 167, 168, 158

(56) References Cited

U.S. PATENT DOCUMENTS

| | | | | |
|---|---|---|---|---|
| 4,856,785 | * | 8/1989 | Lantz et al. | 250/221 |
| 4,879,556 | * | 11/1989 | Duimel | 341/20 |
| 5,589,854 | * | 12/1996 | Tsai | 345/161 |
| 5,694,153 | * | 12/1997 | Aoyagi et al. | 345/161 |
| 5,760,764 | * | 6/1998 | Martinelli | 345/160 |
| 5,847,694 | * | 12/1998 | Redford et al. | 345/158 |
| 5,883,718 | * | 3/1999 | Shu-Ming | 356/373 |
| 5,929,846 | * | 7/1999 | Rosenberg et al. | 345/161 |

* cited by examiner

*Primary Examiner*—Bipin Shalwala
*Assistant Examiner*—Vincent E. Kovalick
(74) *Attorney, Agent, or Firm*—Winston Hsu

(57) ABSTRACT

The present invention provides a computer joystick with high accuracy and stability. The computer joystick comprises a housing, a control stick, two perpendicular sliding channels, two guiding plates, a sliding plate, and two optical encoders. The two guiding plates are horizontally installed in the two sliding channels. The sliding plate is horizontally installed at a bottom end of the control stick in a slidable manner and comprises a recess and two linear sliding holes. Each of the guiding plates comprises a protruding button installed in a corresponding linear sliding hole of the sliding plate. The two optical encoders are used for detecting displacements of the two guiding plates in the two sliding channels and generating corresponding displacement signals. When the control stick is horizontally rotated, it will actuate the sliding plate because the control stick is inserted into the recess of the sliding plate, and the two mutually perpendicular linear sliding holes of the sliding plate will concurrently drive the two guiding plates through the use of protruding buttons of the two guiding plates so that the two optical encoders can generate displacement signals corresponding to the displacement of the control stick.

8 Claims, 4 Drawing Sheets

COMPUTER JOYSTICK

BACKGROUND OF THE INVENTION

1. Field of the Invention

The present invention relates to a computer joystick, and more particularly, to a computer joystick having a sliding plate for actuating two guiding plates for detecting displacements of its control stick.

2. Description of the Prior Art

Computer joysticks are widely used in computer games for controlling cursor or object movements on a screen. A typical computer joystick comprises a housing for storing electronic or mechanical components, an upright control stick rotatable within a fixed angle for controlling cursor movements on the screen, and a plurality of displacement sensors installed at the bottom of the control stick for detecting movements of the control stick in various directions and converting the movements into corresponding displacement signals.

The displacement sensors of a computer joystick typically use variable resistors to detect movements of the control stick. However, utilizing variable resistors has the following three drawbacks:

1. Before each use, the variable resistor of the computer joystick must be calibrated such that control signals are zero.
2. The variable resistor is a passive element and, as such, its output signals easily become inaccurate and unstable upon exposure to environmental factors such as temperature and humidity.
3. Variation in contact point alters the resistance of the variable resistor, however this action may cause damage to the variable resistor leading to a reduction in life span and reduced accuracy of the output signals through mechanical friction and continuous hard contact between the bottom of the control stick and the variable resistor.

SUMMARY OF THE INVENTION

It is therefore a primary objective of the present invention to provide a computer joystick to solve the above mentioned problems.

Briefly, in a preferred embodiment, the present invention provides a computer joystick comprising:

a housing having an opening installed at its top;

a control stick comprising a handle at its top section, a ball-shaped portion at its middle section rotatably installed in the opening of the housing, and a guiding knob at its bottom section;

two mutually perpendicular sliding channels horizontally installed in the housing;

two guiding plates slidably installed in the two sliding channels, each guiding plate comprising a protruding button for actuating the guiding plate;

a sliding plate slidably positioned in the housing comprising a recess for engaging the guiding knob of the control stick and two linear sliding holes perpendicular to each other for engaging the two protruding buttons of the two guiding plates separately; and two optical encoders installed in the housing for detecting displacements of the two guiding plates in the two sliding channels and generating corresponding displacement signals;

wherein when the handle at the top section of the control stick is horizontally rotated, the guiding knob at the bottom section of the control stick will actuate the sliding plate horizontally, and the two linear sliding holes of the sliding plate will concurrently drive the two guiding plates by using the protruding buttons of the two guiding plates so that the two optical encoders can generate the displacement signals corresponding to the displacement of the control stick.

It is an advantage of the present invention that the computer joystick uses two mutually perpendicular linear sliding holes on the sliding plate to control movements of the two guiding plates and to concurrently interact with optical panels for detecting twodimensional movements of the control stick thereby improving the accuracy and stability of the computer joystick.

These and other objectives of the present invention will no doubt become obvious to those of ordinary skill in the art after reading the following detailed description of the preferred embodiment which is illustrated in the various figures and drawings.

DETAILED DESCRIPTION OF THE PREFERRED EMBODIMENT

Figure 1:
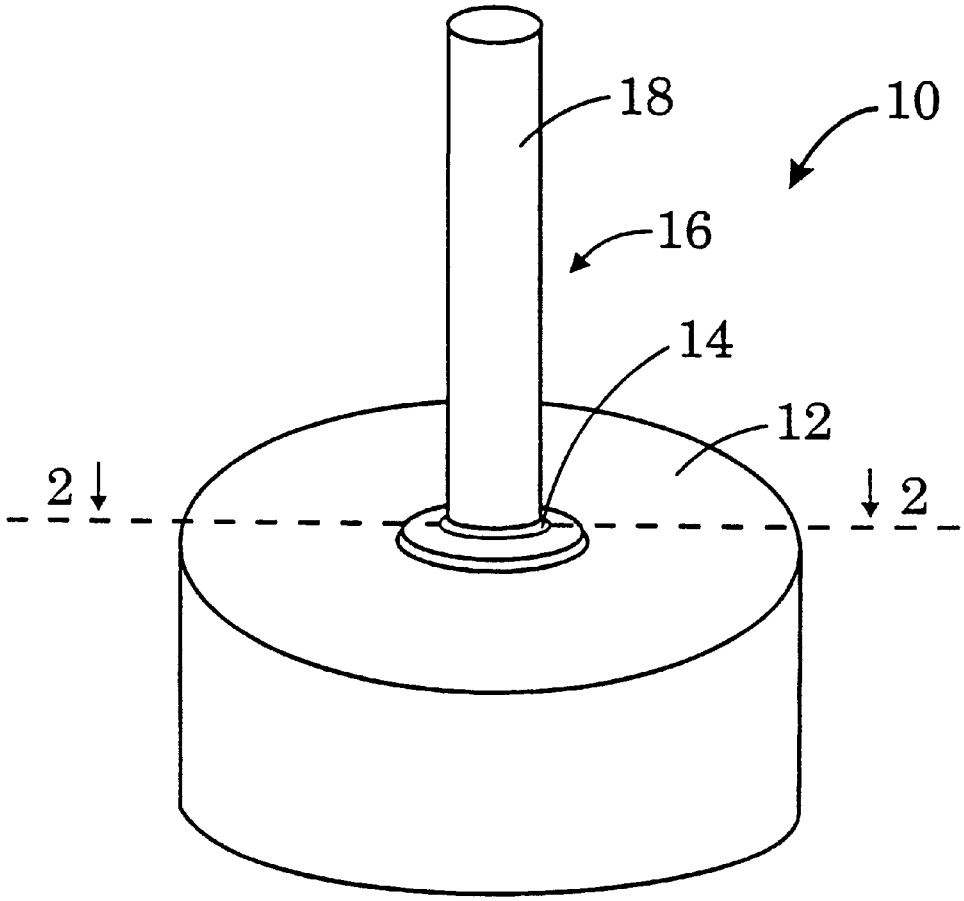
FIG. 1 is a perspective view of a computer joystick according to the present invention.
Figure 2:
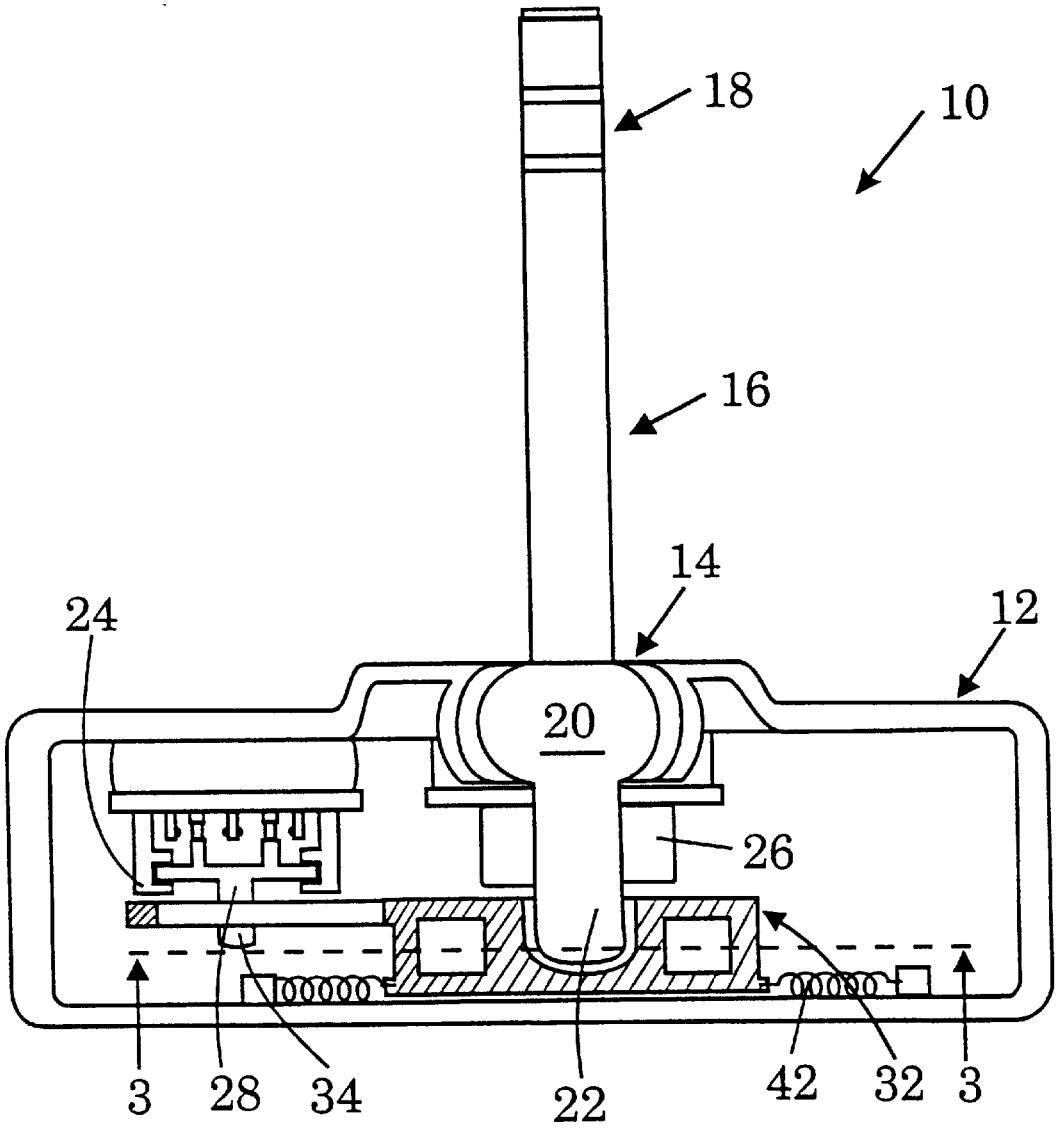
FIG. 2 is a sectional view along line 2—2 of the computer joystick in FIG. 1.

Please refer to FIGS. 1 and 2. FIG. 1 is a perspective view of a computer joystick 10 according to the present invention. FIG. 2 is a sectional view along line 2—2 of the computer joystick 10. The computer joystick 10 comprises a housing 12 with an opening 14 at its top, a control stick 16 rotatably installed inside the opening 14, two mutually perpendicular horizontal sliding channels 24, 26 installed inside the housing 12, two guiding plates 28, 30 horizontally installed inside the sliding channels 24, 26 respectively in a slidable manner, each of the guiding plates 28, 30 comprising a protruding button 34, 36 for actuating the guiding plate 28, 30, a sliding plate 32 horizontally installed at the bottom of the control stick 16 in a slidable manner, two optical encoders (not shown) for detecting movements of the two guiding plates 28, 30 in the two sliding channels 24, 26 and generating corresponding displacement signals, and an elastic device 42 installed below the control stick 16 inside the housing 12 for maintaining the control stick 16 in an upright position. The control stick 16 comprises a ball-shaped portion 20 rotatably installed inside the opening 14 of the housing 12, a handle 18 installed above the ball-shaped portion 20, and a guiding knob 22 installed below the ball-shaped portion 20.

Figure 3:
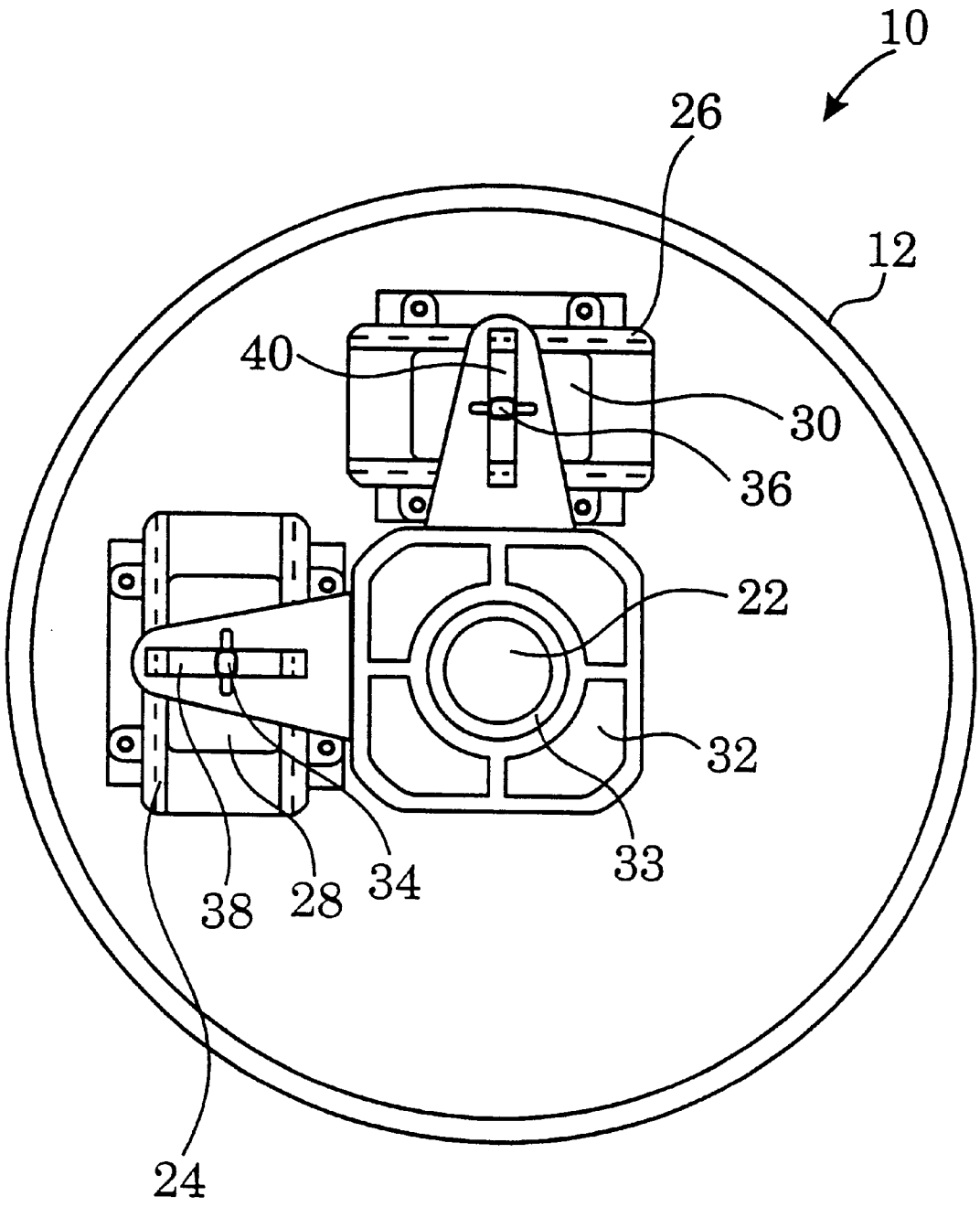
FIG. 3 is a sectional view along line 3—3 of the computer joystick in FIG. 2.

Please refer to FIG. 3. FIG. 3 is a sectional view along line 3—3 of the computer joystick 10 in FIG. 2. The sliding plate 32 comprises a recess 33 installed on it for inserting the guiding knob 22 at a bottom section of the control stick 16 into the sliding plate 32, and two linear sliding holes 38, 40 for installing the protruding buttons 34, 36 of the two guiding plates 28, 30. The two linear sliding holes 38, 40 are mutually perpendicular and separately arranged in a linear manner with the recess 33.

The guiding knob 22 is inserted into the recess 33 so that when the handle 18 at the top section of the control stick 16 is horizontally rotated, the guiding knob 22 at the bottom section of the control stick will actuate the sliding plate 32 horizontally and the two linear sliding holes 38, 40 of the sliding plate 32 will concurrently actuate the two guiding plates 28, 30 along the sliding channels 24, 26 by using the protruding buttons 34, 36 of the guiding plates 28, 30 so that the two optical encoders can generate displacement signals corresponding to the displacement of the control stick 16.

The sliding direction of the guiding plate 28 or 30 is perpendicular with the orientation of the linear sliding hole 38 or 40. For example, when the sliding plate 32 is slid horizontally to the left along the orientation of the sliding hole 38, the linear sliding hole 40 will be driven to the left by the sliding plate 32 which causes leftward movement of the protruding button 36 and the guiding plate 30 in the sliding channel 26, and the optical encoder corresponding to the guiding plate 30 will generate a displacement signal corresponding to the leftward movement. However, when the sliding plate 32 moves toward the left, the linear sliding hole 38 will not drive the protruding button 34 thereby the guiding plate 28 will not slide along a front-and-rear direction in the sliding channel 24, and the optical encoder corresponding to the guiding plate 28 will not generate displacement signals representing the front-and-rear movements. Obviously, the sliding plate 32 can be driven by the control stick 16 to make two-dimensional movements. The guiding plates 28 can separate two-directional movement into two mutually perpendicular onedirectional displacements for detection by the two optical encoders.

Figure 4:
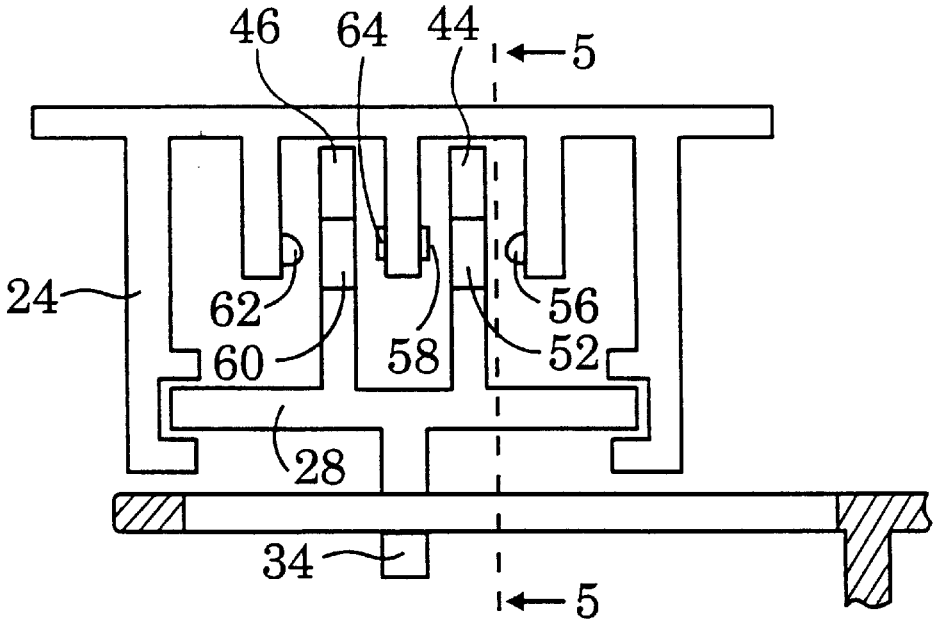
FIG. 4 is a partially detailed view of the computer joystick in FIG. 2.
Figure 5:
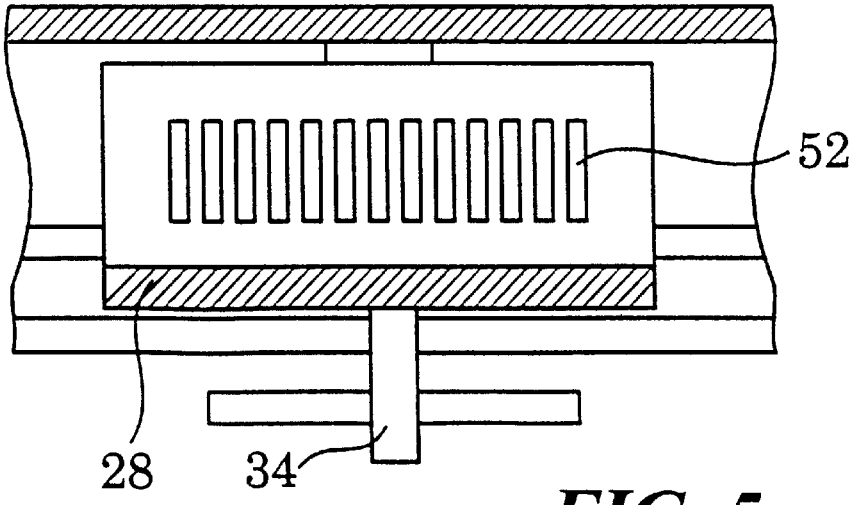
FIG. 5 is a sectional view along line 5—5 of the computer joystick in FIG. 4.

Please refer to FIGS. 4 and 5. FIG. 4 is a detailed view of the guiding plate 28 of the computer joystick 10 and its peripheral components. FIG.5 is a sectional view along line 5—5 of the computer joystick 10 in FIG. 4. A first side wall 44 of each guiding plate 28, 30 comprises a plurality of evenly spaced pinholes 52 forming a light panel, and a second side wall 46 of each guiding plate 28, 30 comprises a positioning hole 60. Each of the sliding channels 24, 26 comprises two light sources 56, 62 and two corresponding light sensors 58, 64. The detection of displacement of the guiding plates 28, 30 in terms of the horizontal sliding channel 24 and the guiding plate 28 is explained as follows: When the guiding plate 28 slides in the horizontal sliding channel 24, the light source 56 and the light sensor 58 installed in each of the two sliding channels positioned at two sides of the first side wall 44 for detecting displacements of the guiding plate 28 in the sliding channel and generating corresponding displacement signals. The light source 62 and the light sensor 64 at two sides of the second side wall 46 of the guiding plate 28 use the positioning hole 60 on the second side wall 46 to detect the position of the guiding plate 28 in the horizontal sliding channel 24 and to generate corresponding positioning signals. Because the number of pinholes 52 is fixed, the maximum and minimum amount of displacement of the guiding plate 28 is set, and therefore calibration of the displacement signals is unnecessary.

Compared with a prior art computer joystick, the computer joystick 10 uses two mutually perpendicular linear sliding holes 38, 40 on the sliding plate 32 to control movements of the two guiding plates 28, 30, and to interact concurrently with the optical panels for detecting two-dimensional movements of the control stick 16. Such detecting arrangements replace the variable resistors used by the prior art computer joystick, and the displacement signals generated do not need to be calibrated therefore providing a highly accurate and stable computer joystick.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A computer joystick comprising:

a housing having an opening installed at its top;

a control stick comprising a handle at its top section, a ball-shaped portion at its middle section rotatably installed in the opening of the housing, and a guiding knob at its bottom section;

two mutually perpendicular sliding channels horizontally installed in the housing;

two guiding plates slidably installed in the two sliding channels, each guiding plate comprising a protruding button;

a sliding plate slidably positioned in the housing comprising a recess for engaging the guiding knob of the control stick and two linear sliding holes perpendicular to each other for engaging the two protruding buttons of the two guiding plates separately; and two optical encoders installed in the housing for detecting displacements of the two guiding plates in the two sliding channels and generating corresponding displacement signals;

wherein when the handle at the top section of the control stick is horizontally rotated, the guiding knob at the bottom section of the control stick will actuate the sliding plate horizontally, and the two linear sliding holes of the sliding plate will concurrently drive the two guiding plates by using the protruding buttons of the two guiding plates so that the two optical encoders can generate the displacement signals corresponding to the displacement of the control stick.

2. The computer joystick of claim 1 wherein the sliding direction of each of the guiding plates is perpendicular to the orientation of the linear sliding hole engaged on the protruding button of the guiding plate wherein when the sliding plate slides along the orientation of the linear sliding hole, the linear sliding hole will not actuate the protruding button of the guiding plate, and when the sliding plate slides perpendicular to the orientation of the linear sliding hole, the linear sliding hole will actuate the protruding button of the guiding plate along the corresponding sliding channel.

3. The computer joystick of claim 1 further comprising an elastic device installed between the housing and the guiding knob of the control stick for maintaining the control stick in an upright position.

4. The computer joystick of claim 1 wherein each of the two guiding plates comprises a first side wall, and each of the optical detectors comprises a plurality of evenly spaced pinholes installed in the first side wall, a light source and a light sensor installed in each of the two sliding channels positioned at two sides of the first side wall for detecting displacements of the guiding plate in the sliding channel and generating corresponding displacement signals.

5. The computer joystick of claim 4 wherein each of the two guiding plates further comprises a second side wall parallel to the first side wall and having a positioning hole in it, wherein the computer joystick further comprises a light source and a light sensor installed in each of the two sliding channels positioned at two sides of the second side wall for detecting the positioning hole and generating corresponding positioning signal to indicate the position of the guiding plate in the horizontal sliding channel.

6. A computer joystick comprising:

a housing having an opening installed at its top;

a control stick comprising a handle at its top section, a ball-shaped portion at its middle section rotatably installed in the opening of the housing, and a guiding knob at its bottom section;

two mutually perpendicular sliding channels horizontally installed in the housing;

two guiding plates slidably installed in the two sliding channels respectively, each guiding plate comprising a protruding button, a first wall, and a second wall parallel to the first wall;

a sliding plate slidably positioned in the housing comprising a recess for engaging the guiding knob of the control stick and two linear sliding holes perpendicular to each other for engaging the two protruding buttons of the two guiding plates separately; and two optical encoders installed in the housing for respectively detecting displacements of the two guiding plates in the two sliding channels and generating corresponding displacement signals, each optical encoder comprising:

a plurality of evenly spaced pinholes installed in the first wall of the respective guiding plate, a first light source and a first light sensor installed in the respective sliding channel positioned on two sides of the first wall for detecting displacements of the guiding plate in the sliding channel and generating corresponding displacement signals, and one positioning hole installed in the second wall of the respective guiding plate, a second light source and a second light sensor installed in the respective sliding channel positioned on two sides of the second wall for detecting the positioning hole and generating a corresponding positioning signal to indicate a respective calibration position of the guiding plate in the horizontal sliding channel;

wherein when the handle at the top section of the control stick is horizontally rotated, the guiding knob at the bottom section of the control stick will actuate the sliding plate horizontally, and the two linear sliding holes of the sliding plate will concurrently drive the two guiding plates by using the protruding buttons of the two guiding plates so that the two optical encoders generate the displacement signals and positioning signals corresponding to the displacement of the control stick.

7. The computer joystick of claim 6 wherein the sliding direction of each of the guiding plates is perpendicular to the orientation of the linear sliding hole engaged on the protruding button of the guiding plate wherein when the sliding plate slides along the orientation of the linear sliding hole, the linear sliding hole will not actuate the protruding button of the guiding plate, and when the sliding plate slides perpendicular to the orientation of the linear sliding hole, the linear sliding hole will actuate the protruding button of the guiding plate along the corresponding sliding channel.

8. The computer joystick of claim 6 further comprising an elastic device installed between the housing and the guiding knob of the control stick for maintaining the control stick in an upright position.

* * * * *